United States Patent [19]

Matsuya et al.

[11] Patent Number: 5,040,908

[45] Date of Patent: Aug. 20, 1991

[54] PASSBOOK PRINTER WITH LINE FIND MECHANISM

[75] Inventors: Mikio Matsuya; Takemi Kobayashi, both of Oiso, Japan

[73] Assignee: NCR Corporation, Dayton, Ohio

[21] Appl. No.: 572,836

[22] Filed: Aug. 27, 1990

[30] Foreign Application Priority Data

Nov. 30, 1989 [JP] Japan ..... 1-309443

[51] Int. Cl.[5] ..... B41J 5/30

[52] U.S. Cl. ..... 400/62; 400/24; 400/56; 400/105; 400/708; 235/379; 235/432; 235/454; 235/479; 382/65

[58] Field of Search ..... 400/62, 23, 56, 24, 400/59, 279, 104, 282, 105, 68, 708; 235/379, 439, 454, 470, 475, 479, 432; 382/11, 65

[56] References Cited

U.S. PATENT DOCUMENTS

| | | | |
|---|---|---|---|
| 3,718,244 | 2/1973 | Bukowski et al. . | |
| 3,803,388 | 4/1974 | Williamson et al. . | |
| 3,951,251 | 4/1976 | Zaccagnino, Jr. | 400/105 |
| 3,978,964 | 9/1976 | Kwan . | |
| 4,279,413 | 7/1981 | Siwik et al. | 400/24 |
| 4,438,236 | 3/1984 | Uchida | 235/379 |
| 4,494,127 | 1/1985 | King | 400/105 |
| 4,506,274 | 3/1985 | Coe | 235/377 |
| 4,524,268 | 6/1985 | Fukatsu | 235/379 |
| 4,641,239 | 2/1987 | Takejako | 235/379 |
| 4,676,675 | 6/1987 | Suzuki et al. | 400/56 |
| 4,743,129 | 5/1988 | Keryhuel et al. . | |
| 4,791,678 | 12/1988 | Iwase et al. | 382/54 |
| 4,804,830 | 2/1989 | Miyagisima et al. | 235/379 |
| 4,944,616 | 1/1990 | Watanabe et al. | 400/105 |
| 4,983,053 | 1/1991 | Tsukui | 400/62 |

FOREIGN PATENT DOCUMENTS

| | | | |
|---|---|---|---|
| 2321988 | 12/1973 | Fed. Rep. of Germany | 400/56 |
| 2717126 | 11/1978 | Fed. Rep. of Germany | 400/605 |
| 2812482 | 9/1979 | Fed. Rep. of Germany | 400/613 |
| 5851403 | 10/1974 | Japan . | |
| 0159366 | 9/1984 | Japan | 400/605 |
| 0229372 | 12/1984 | Japan | 400/24 |
| 0229373 | 12/1984 | Japan | 400/624 |
| 0116880 | 5/1988 | Japan | 400/24 |
| 2186844 | 8/1987 | United Kingdom | 400/56 |
| 2197824 | 6/1988 | United Kingdom | 400/708 |

OTHER PUBLICATIONS

"Self-Contained Magnetic Stripe Reader/Encoder" IBM Tech. Discl. Bulletin, vol. 20, No. 5, 10/77 pp. 1879-1888.

"Variable Traverse Control for Document Reader with Lane-Marking Capability" IBM Tech. Discl. Bulletin, vol. 14, No. 3, 8/71, pp. 879-880.

*Primary Examiner*—Eugene H. Eickholt

*Attorney, Agent, or Firm*—Wilbert Hawk, Jr.; Albert L. Sessler, Jr.; Matthew R. Jenkins

[57] ABSTRACT

A passbook printer has a print head movable along a printing station and in opposed relation to a platen for printing data on the passbook. The printer has an optical reading head assembly which is movable independent of the print head and in a direction of the path of the passbook past the printing station. The optical reading head assembly is positioned at the printing station for reading page and line information from the passbook and then is moved to a position adjacent the printing station.

12 Claims, 4 Drawing Sheets

PASSBOOK PRINTER WITH LINE FIND MECHANISM

BACKGROUND OF THE INVENTION

In the field of financial-type business transactions, a commonly used record medium is a passbook or bankbook for maintaining a record for each transaction. The passbook is inserted into a business machine for reading the contents of the passbook, for printing information or data in the passbook, and for recording the printed information or data in the passbook.

In the operation of the business machine for passbook printing therein, the passbook is inserted at the front of the machine and the passbook is then transported or conveyed past a printing station toward the rear of the machine where the current status of the record is read by means of read/write mechanism from a magnetic stripe on the passbook. The passbook is then transported to the printing station for printing operation after which the passbook is again transported toward the rear of the machine where the printed information is recorded by means of the read/write mechanism in a write operation on the magnetic stripe. The passbook is then transported toward the front and out of the business machine.

The passbook printer includes a printing section and an optical reading device for reading page information on the passbook and for detecting the last print line so as to enable printing of additional text.

In a passbook printer of the prior art, there is provided an optical reading device for reading page information printed in the form of bar codes and for detecting the last print line in a passbook. The passbook is inserted into the passbook printer in the open state, and after page information and other data have been read out by an optical reading device and a position at which the printing operation is to be performed has been confirmed, information is printed on the passbook by the printing means.

The page information reading operation, the printing operation and the read/write operation are started after the passbook has been completely housed within the printer in order to prevent intervention from outside the printer, such as drawing out or attempting to draw out the passbook prior to or during any of the above operations. In a conventional printer, the optical reading device is provided at a position wherein the distance between the passbook insert port and an optical reader is greater than the length of the passbook in the open state, and the printing station of such printer is provided at a further inner part of the printer or at still a greater distance from the insert port.

In the conventional printer and regarding the length of a passbook feed path for reaching the printing station, a length that is required to accommodate the passbook is obtained by adding the length of the open passbook to an additional length extending from the optical reading device to the printing station. In addition, for the optical reading operation, it is necessary to adjust a gap between the reading head and the surface of the passbook in accordance with the thickness of the passbook in a separate operation or section of the printer from the printing section of the printer and hence a separate gap adjusting mechanism is required.

Representative documentation in the field of passbook printer mechanisms includes U.S. Pat. No. 3,718,244, issued to R. J. Bukowski et al. on Feb. 27, 1973, which discloses apparatus for reading preprogrammed cards and for printing on a card having a program area and a printing area. The apparatus includes card guide means, a card position scanning head, and printing means.

U.S. Pat. No. 3,803,388, issued to A. C. Williamson et al. on Apr. 9, 1974, discloses passbook reading and writing mechanism which includes a transducing head, a sensor for sensing the edge of the passbook, and means for moving the head into engagement with a magnetic stripe.

U.S. Pat. No. 3,978,964, issued to O. Kwan on Sept. 7, 1976, discloses a magnetic head control assembly for a passbook that includes a line positioning device and means for moving a magnetic head scanning assembly toward and from a magnetic stripe.

U.S. Pat. No. 4,743,129, issued to A. Keryhuel el al. on May 10, 1988, discloses a passbook printer having a sensor which detects a mark on the passbook to determine which edge of the passbook is aligned with a barrier in the path of travel of the passbook.

Japanese No. 59-178279/84 discloses a sensor on a movable carriage. The sensor detects a first mark, the carriage is moved across the paper, and the sensor detects a second mark spaced from the first mark.

SUMMARY OF THE INVENTION

The present invention relates to a business machine for use in financial transactions and more particularly to a passbook printer mechanism. The passbook includes a magnetic stripe on the cover thereof which incorporates data or information concerning the customer's account. A read head on the business machine reads data from the magnetic stripe and a write head writes data into and records such data in the magnetic stripe. The passbook printer includes an optical reading head which is positioned at a print station for detecting the last print line and which is movable from the print station to enable printing of additional lines of text or characters.

In order to solve the above problem dealing with the greater required length of the passbook feed path, the present invention is constructed such that a reading head of an optical reader is movably provided, whereby an optical reading operation is first performed at the printing station, and then during a printing operation the print head can freely move along the printing station after the optical reading head is retreated or displaced from the printing station.

According to the present invention, the optical reading operation is performed in a position at the printing station, so that there is no need to provide a longer feed path between the optical reading device and the printing station. In addition, during the printing operation, the optical reading head is retreated to a position wherein the print head is free to move along the printing station.

Further, in regard to the adjustment of the gap between the reading head and the surface of the passbook, a gap adjusting mechanism at the printing station can be utilized in the present condition, so that neither a separate gap adjusting mechanism for the optical reading operation nor an additional gap adjusting operation is needed.

In accordance with the above discussion, there is provided a passbook printer mechanism in a business machine which includes a print head, a platen and a print head carriage, an optical reading head adapted to read page information on a passbook and to detect the last print line to enable the print head to print the next transaction on the page of the passbook, and means for moving the optical reading head from a first position along the printing line where the optical reading head detects the last print line to a second position adjacent the printing line whereby the print head can freely move along the printing line.

In view of the above discussion, a principal object of the present invention is to provide an optical reading mechanism for a passbook printer.

Another object of the present invention is to provide an optical reading mechanism for reading page information on a passbook.

An additional object of the present invention is to provide a movable optical reading device for detecting the last print line on a passbook.

A further object of the present invention is to provide a passbook printer having an optical reading head positioned along a print line for detecting the last printed line and means for moving the optical reading head to a position adjacent the print line thereby enabling printing of data on the next line of the passbook.

Additional advantages and features of the present invention will become apparent and fully understood from a reading of the following description taken together with the annexed drawing.

DESCRIPTION OF THE PREFERRED EMBODIMENT

Figure 1B:
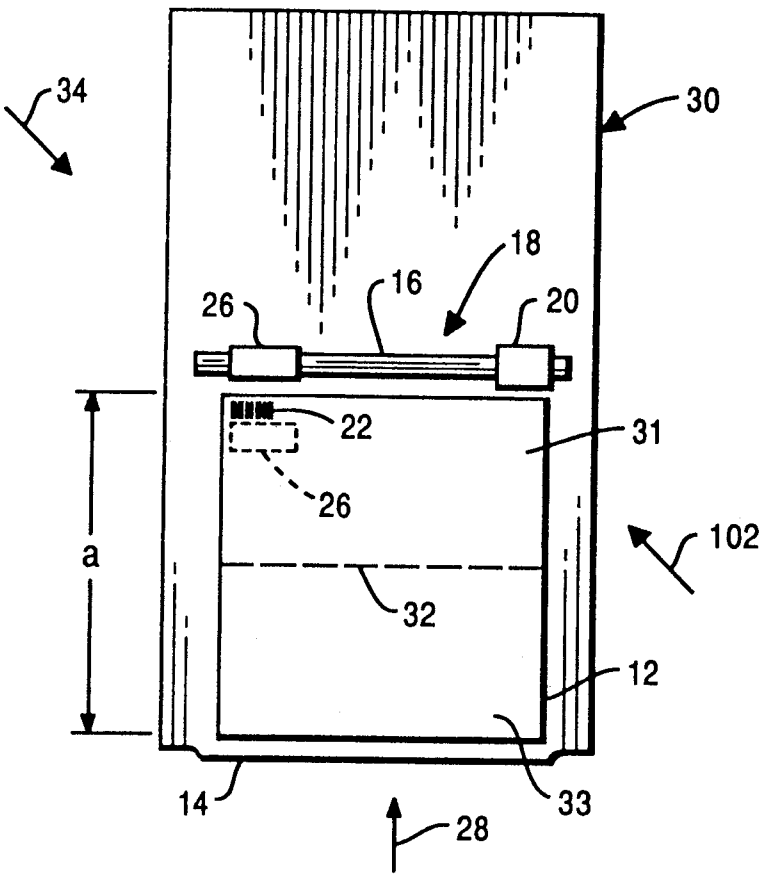
FIG. 1(B) is a diagrammatic plan view of a passbook printer incorporating the subject matter of the present invention.
Figure 1A:
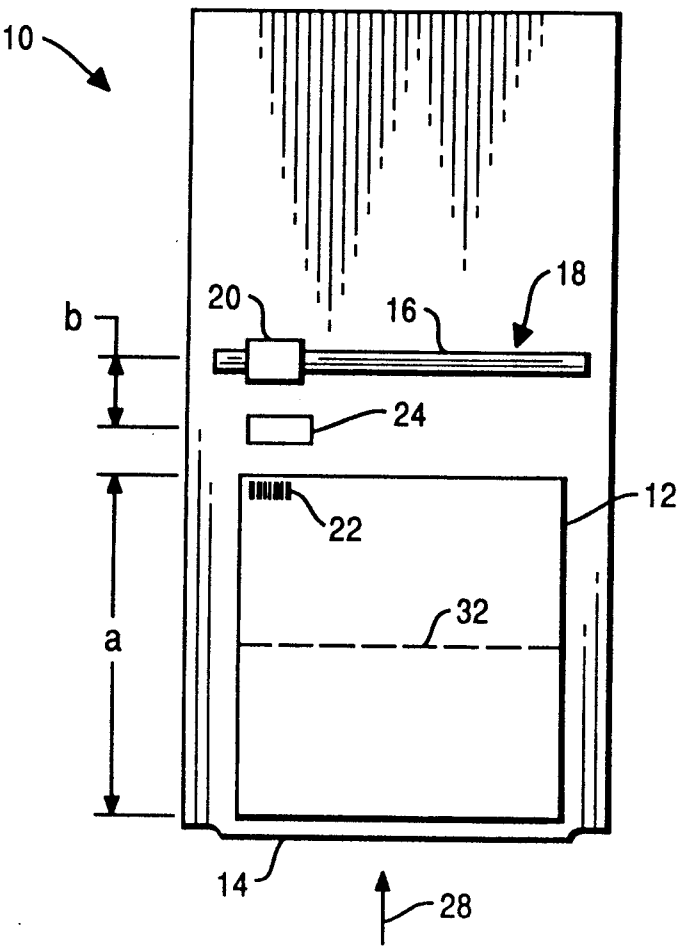
FIG. 1(A) is a diagrammatic plan view of a passbook printer and including known or conventional structure.

Referring now to the drawing, FIG. 1(A) is a plan view of a printer 10 in diagrammatic form for receiving a passbook 12 through an insert port 14. The printer 10 includes a platen 16 extending across a portion of the width of the printer and the platen is located at or along a printing station 18. A print head 20 moves along the printing station 18 in opposed relationship to the platen 16 for printing operation. The passbook 12 includes a bar code 22 at one corner thereof and an optical reading device 24 is provided in the path of the bar code for reading the bar code as the passbook 12 travels in a path toward the printing station 18. The optical reading device 24 is positioned in a fixed location at a distance "b" from the printing station 18 to enable the print head 20 to move back and forth along the platen 16 in printing operations. The passbook 12 occupies a length "a" of the printer 10 when the passbook is open and is inserted into the insert port 14 and is fully housed within the printer 10. It is thus seen that the distance between the insert port 14 and the platen 16 is at least greater than the length "a" of the passbook 12 and the distance "b" from the printing station 18 to the reading device 24.

FIG. 1(B) is a plan view of a printer 30 in diagrammatic form and includes the insert port 14, the platen 16, the printing station 18 and the print head 20. The passbook 12 has the bar code 22 in the same relative position as shown in FIG. 1(A). An optical reading device or assembly 26 is shown in a position over the top of the platen 16 and the print head 20 is shown at the right side of the platen 16. An alternative position is shown for the optical reading device 26 in a dotted line illustration. It is thus seen in FIG. 1(B) that the passbook 12 is in the open position and is fully housed within the printer 30, and that the edge of the passbook 12 with the bar code 22 is adjacent the platen 16. In this regard, FIG. 1(B) shows that the printer 30 is shorter in length, as viewed in the direction of the path of travel of the passbook 12, than the printer 10 by about the distance "b", as seen in FIG. 1(A). When the passbook 12 has been inserted into the printer 30 in the direction of the arrow 28, the passbook 12 occupies a lesser space in the printer 30 by reason that the edge of the passbook 12 with the bar code 22 is closer to the platen 16 and the printing station 18. In the open position of the passbook 12, a fold line 32 is exhibited by the upper and lower page portions 31 and 33 of the passbook 12.

Figure 2:
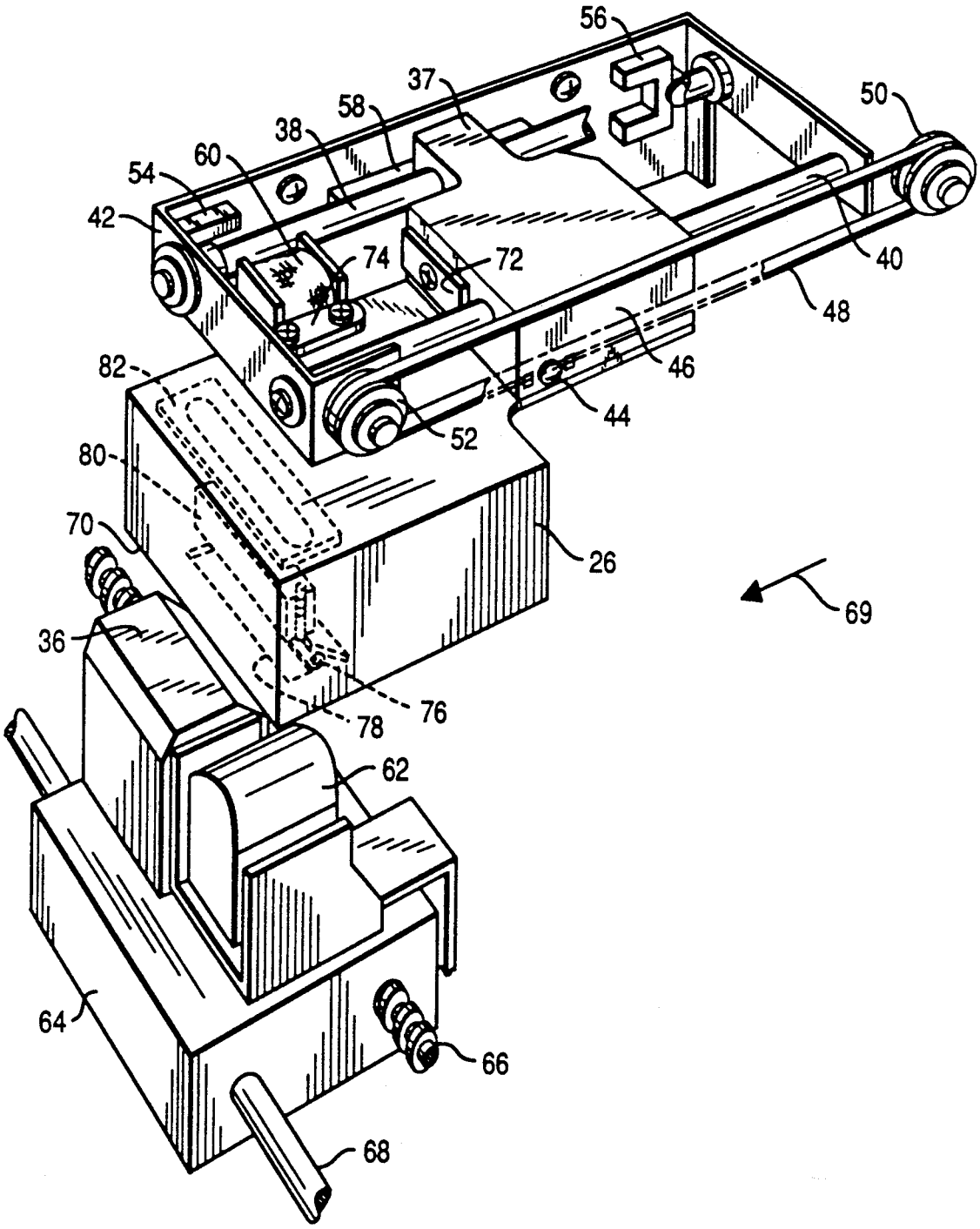
FIG. 2 is a perspective view of a drive arrangement for an optical reading device of the passbook printer.

FIG. 2 is a perspective view of a drive arrangement for the optical read head assembly 26 used in the present invention and the view is looking from the direction of an arrow 34 in FIG. 1(B). FIG. 1(B) is a conceptual-like illustration whereas FIG. 2 shows a concrete embodiment of the present invention. A structural difference in the two views (FIG. 1(B) and FIG. 2) is that a fixed platen 16 is used in FIG. 1(B), whereas a movable platen 36 is used in FIG. 2. The optical head assembly 26 is slidably supported by means of a block member 37 on two shafts 38 and 40 which are fixed to a generally U-shaped supporting member 42 that is a part of the printer housing (not shown). A connecting element or projection 44 on a side wall 46 of the optical head assembly 26 is connected to a wire or cable 48 which is stretched between and trained around two pulleys 50 and 52. A pair of optical sensors 54 and 56 are supported in opposed manner by the member 42 and are adapted to detect a stopping position of the optical read head assembly 26. The optical sensors 54 and 56 are positioned adjacent the shaft 38. A plate 58 is provided as a part of the assembly 26 and is positioned in the light path of the sensors 54 and 56 to detect a stopping position of the assembly 26. An electromagnet 60 is supported from the member 42 and operates to hold the read head assembly 26 in position during the optical reading operation. A magnetic read/write head 62 which has no direct relation with the present invention is supported on a carriage 64 that also supports the platen 36. The carriage 64 is moved across the printer by means of a lead screw 66 and a guide rod or shaft 68. The movable platen 36 and the read/write head 62 are integral with the carriage 64. As an alternative structure, the conventional fixed platen 16, as shown in FIGS. 1(A) and 1(B) and which extends from side to side of the printer, may be used with a magnetic head that is separate from the platen.

In the above-described arrangement, the assembly 26 is driven toward and from the platen 36 in the direction of an arrow 69 by a motor (not shown). When the pulley 50 is rotated by the motor, the wire or cable 48 is driven thereby and the assembly 26 is moved toward and from the platen 36 in accordance with the driving direction of the wire 48 and the motor. FIG. 2 shows the condition wherein the assembly 26 is moved to an intermediate position in order to clearly show the sensors 54 and 56. The optical reading operation is performed in a condition wherein a head portion 70 of the assembly 26 is moved to a position, as shown in FIG. 1(B), directly above the platen 16. In such position, a position fixing plate 72 secured to one side of the block member 37 of the assembly 26 comes into magnetic contact with an iron core (not shown) of the electromagnet 60 and with an iron plate 74 which is connected to the electromagnet 60 to form a closed magnetic path to hold the assembly 26 in the reading operation position.

The optical read head portion 70 of the assembly 26 includes an LED (light emitting diode) assembly 76, an opening 78 in the bottom of the portion 70, a lens assembly 80 and a photosensor assembly 82. The light emitted from the LED 76 is radiated to a bar code 22 or the like on the passbook 12 through the opening 78. The light reflected from the bar code 22 passes again through the opening 78 and is received by the photosensor assembly 82 through the lens assembly 80. The light received by the photosensor assembly 82 is converted into an electric signal and such signal is sent to a bar code recognizing means or last print line detecting means (not shown). The electric signal is analyzed by the recognizing means or the detecting means and is read out as the last detected print line.

Figure 3:
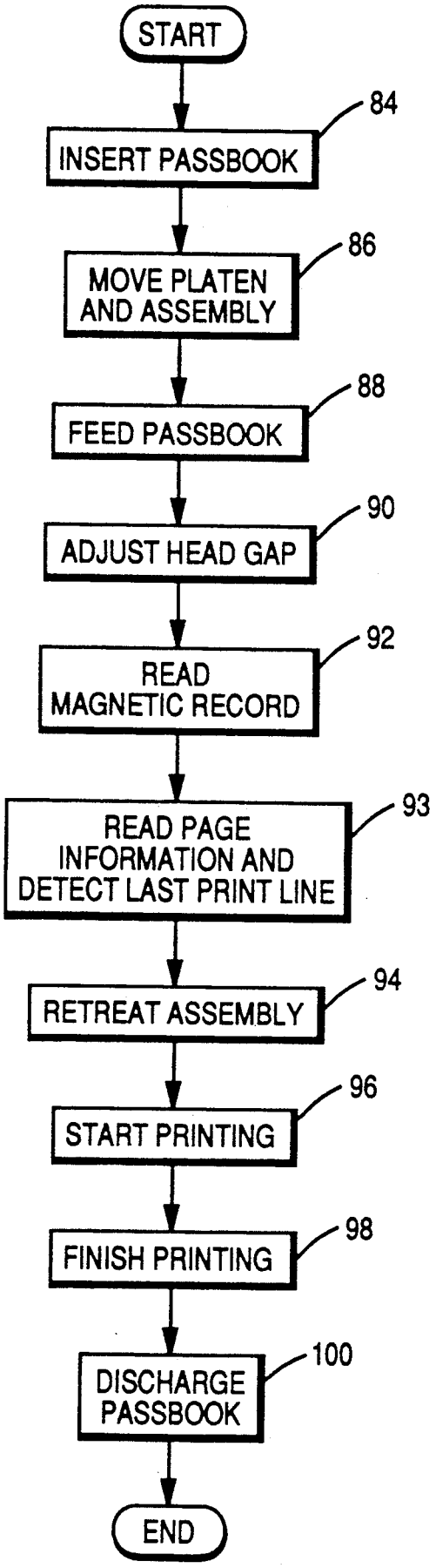
FIG. 3 is a flow chart illustrating the basic operation of the passbook printer.

Next, the basic operation of the passbook printer 30 according to the embodiment of the present invention will be described with reference to the flow chart shown in FIG. 3. The printing operation on the passbook 12 is performed by controlling means (not shown) which includes Read Only Memory (ROM) and Random Access Memory (RAM) in accordance with procedures stored in the ROM.

When a passbook 12 is inserted into the passbook printer insert port 14 of the passbook printer 30, as shown in FIG. 1(B), and indicated at block 84 (FIG. 3), the platen 36 moves to the left along the printing station 18 and the assembly 26 moves onto the printing station (Block 86). These operations allow the passbook to pass successfully through the printing station. Simultaneously therewith, the passbook 12 is fed into the passbook printer 30 by conveying means (not shown) and indicated at block 88. When the passbook 12 is fed to a predetermined position, the gap between the passbook and the read head 70 is adjusted in accordance with the thickness of the passbook (Block 90). Through the one-time gap adjustment, as described later, the gaps between the print head 20 and the passbook 12 and between the read head 26 and the passbook 12 are adjusted to appropriate values for the printing operation, for the magnetic read/write operation, and for the optical reading operation.

In the next operation, the magnetic reading head 62 reads the magnetic stripes on the cover of the passbook 12 (Block 92). At the completion of the magnetic reading operation, the optical reading head 70 reads page information and detects the last print line (Block 93). At the completion of the page reading operation and the last print line detecting operation, the assembly 26 retreats backward (Block 94). Then, the printing operation is performed by the print head 20 in accordance with the requirements and contents of the business transactions (Block 96). At the completion of the printing operation (Block 98), the passbook 12 is discharged from the insert port 14 (Block 100) after recording the printed information in the passbook.

Figure 4:
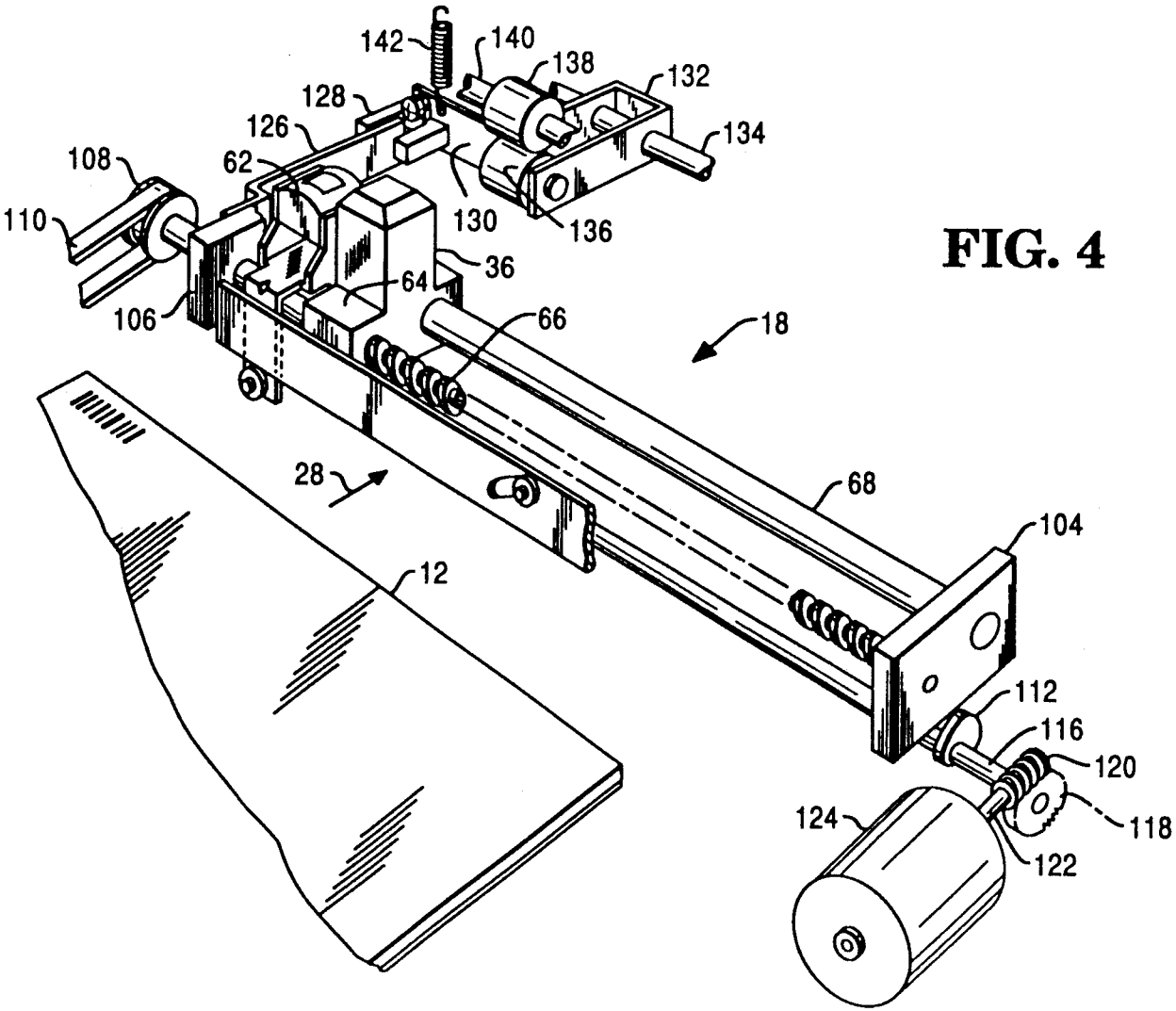
FIG. 4 is a perspective view illustrating gap adjusting mechanism for the print head and the optical reading device of the present invention.

FIG. 4 is a perspective view of the printing station 18 looking from the direction, as indicated by an arrow 102 in FIG. 1(B). In the drawing, the carriage 64 is slidably carried on the guide rod 68 which is coupled to side brackets or support plates 104 and 106. The carriage 64 is driven by the lead screw 66 which is also coupled (in the manner of being journaled in) the side brackets 104 and 106. The side brackets 104 and 106 are supported in a manner to be swingable about the lead screw 66. The lead screw 66 has a pulley 108 secured to the left end thereof and a belt 110 is trained around the pulley 108 and around a pulley secured to the end of a shaft of a suitable drive motor (the pulley, the shaft and the motor not being shown). The read/write magnetic head 62 is supported by the carriage 64 and is positioned adjacent the platen 36.

The right and left brackets 104 and 106 (FIG. 4) are supported on respective right and left cams 112 (the left hand cam under bracket 106 not being shown) which are provided on a shaft 116 suitably journaled on the printer 30. The carriage 64 which carries the platen 36 and the magnetic head 62 is supported by means of the right and left brackets 104 and 106 engaging the cams 112 of the shaft 116. The shaft 116 has a gear 118 secured to the right end thereof which gear meshes with a gear 120 on the end of a shaft 122 of a stepping motor 124. The carriage 64 is caused to be raised and lowered by rotational driving of the shaft 116 and of the cams 112 by the motor 124 wherein the gap between the print head 20 and the platen 36 is varied to adjust or compensate for passage of a record medium such as the passbook 12. The platen 36, the read/write head 62, the lead screw 66 and the shaft 68, the support plates 104 and 106, and the pulley 108 are structured in an integrated manner to constitute an assembly of the printing station 18 which is movable and is swung in a generally vertical direction by the motor 124 around the axis of the lead screw 66.

A detection arm 126 is secured to the left bracket 106 and extends in one direction therefrom and is positioned to be detected by a sensor 128. The detection arm 126 is constructed so as to shield the light path of the optical sensor 128. The sensor 128 is attached to an end 130 of a support arm 132. The support arm 132 is carried on a shaft 134 and such arm 132 supports a lower roller 136 that is opposed to an upper roller 138 carried on a shaft 140. The lower roller 136 is movable and is swingable on the shaft 134 whereas the upper roller 138 is in fixed position relative to the lower roller 136. The lower movable roller 136 and the upper fixed roller 138 are arranged to grip the passbook 12 therebetween as the passbook is conveyed along the feed path in the printer 30. A coil spring 142 is connected to one end of the support arm 132 and to a suitable frame portion of the printer 30 to urge the lower roller 136 against the upper roller 138 for gripping the passbook 12. The upper roller 138 and the lower roller 136, in effect, operate in an arrangement as a passbook thickness detecting mechanism. The sensor 128 detects upward movement of the platen 36 and the read/write head 62 on the carriage 64.

For the optical reading operation, it is necessary to adjust the gap between the passbook 12 and the read head portion 70 in an appropriate manner. In the present invention, the optical reading operation is performed at the printing station 18 and the heights of the platen 36 and the optical read head assembly 26 are adjusted in advance so that the correct gap is provided for both the reading and the printing operations. In this regard, the correct gap is provided between the optical read head 70 and the passbook 12 upon the adjustment of the gap between the print head 20 and the passbook 12 so that an additional adjustment of the gap between the optical read head 70 and the passbook 12 is not required. The present structure eliminates the need for a separate gap adjustment mechanism and a separate operation.

In the above-described arrangement, the passbook 12 is fed in a direction shown by the arrow 28, as viewed in FIG. 1(B), and is sandwiched between the rollers 136 and 138 (FIG. 4). When the passbook 12 is sandwiched between rollers 136 and 138, the roller 136 moves down by the amount corresponding to the thickness of the passbook 12 and the support arm 132 rotates counterclockwise about the shaft 134 relative to the fixed roller 138 on the shaft 140. The optical sensor 128 moves downward by reason of the rotation of the support arm 132. In this regard, the thicker the passbook 12, the more increased is the downward movement of the sensor 128.

Next, the motor 124 rotates to cause the shaft 116 to rotate in a counterclockwise direction (FIG. 4), by which the printing station assembly moves upward. When the printing station assembly moves upward and the arm 126 shields the light path of the sensor 128, the motor 124 is stopped. The sensor 128 moves in the vertical direction in accordance with the thickness of the passbook, so that the height of the printing station assembly is adjusted in accordance with the thickness of the passbook 12. In other words, the height of the printing station assembly is adjusted such that the height of the surface of the passbook 12 on which the printing operation is to be performed is constant based on the height of the roller 138. Therefore, by adjusting the individual heads, namely, the print head 20, the read/-write head 62, and the optical read head 26, to such heights that the gaps between the print surface of the passbook 12 and the individual heads are optimized based on the height of the roller 138, the adjustment of all the head gaps can be accomplished by a one-time gap adjusting operation.

The present invention is constructed such that the optical reading assembly 26 is movable or displaceable from the printing station, the optical reading operation and the line detecting operation are performed at the printing station, and the optical reading assembly is removed or displaced from the printing station to enable the printing operation, all in an arrangement wherein the feed path of the passbook can be shortened and the size of the printer can be reduced. The providing of the movable optical read assembly 26 from the printing station 18 enables miniaturization of the overall apparatus. In addition, the optical reading operation and the line detecting operation are performed at the printing station, so that simply adjusting the print head gap also adjusts the reading gap of the optical read head to the optimum value and hence a re-adjustment of the reading gap is not necessary.

It is thus seen that herein shown and described is a passbook printer having a print station assembly that is movable as an integral structure to adjust the gap between the passbook and the print head and having an optical read head for detecting the last print line, the optical read head being movable from the print station to enable printing the next line of print.

The structure and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A passbook printer comprising a carriage, a print head movable across the printer, a platen operating at a printing station with said print head and carried by said carriage, means for driving said carriage across said printer in a direction normal to the path of the passbook past the printing station, optical reading means operably associated with said printing station and with said passbook for reading printing information on said passbook, and means for moving the optical reading means from a first position along the printing station where the optical reading means detects the last print line to a second position adjacent the printing station whereby the print head can freely move along the printing station and the platen for printing the next line of printing.

2. The passbook printer of claim 1 wherein the optical reading means comprises an optical read head positioned in opposed manner to said platen at said printing station.

3. The passbook printer of claim 1 wherein the optical reading means includes light emitting means and a photosensor assembly for receiving reflected light from said passbook and for converting the received light into a signal indicative of the last print line.

4. The passbook printer of claim 1 including means operably associated with said carriage and with said optical reading means for sensing the thickness of said passbook.

5. The passbook printer of claim 1 wherein said optical reading means comprises an optical read head movable in the direction of the path of the passbook past the printing station and said moving means includes electromagnetic means operable to position the optical read head at the printing station during a optical reading operation.

6. The passbook printer of claim 1 wherein the moving means comprises a generally U-shaped member for supporting said optical reading means and means for driving the U-shaped member from said first position to said second position.

7. In a passbook printer having a print head, means for moving the print head across the printer, a carriage for carrying a platen along a printing station, and means for moving the carriage across the printer in a direction normal to the path of the passbook past the printing station, the improvement comprising an optical reading head operably associated with said printing station and with said passbook for reading printed information on said passbook and means for moving the optical reading head from a first position at said printing station where the optical reading head detects the last print line to a second position adjacent the printing station whereby the print head can freely move along the printing station and the platen for printing the next line of printing.

8. In the passbook printer of claim 7 wherein the optical reading head includes light emitting means and light receiving means positioned in opposed manner to said platen at said printing station.

9. In the passbook printer of claim 7 wherein the optical reading head includes a photosensor assembly for receiving reflected light from reading information on said passbook and for converting the received light into a signal indicative of the last print line.

10. In the passbook printer of claim 7 including means operably associated with said carriage and with said optical reading means for sensing the thickness of said passbook.

11. In the passbook printer of claim 7 wherein said optical reading head is movable to and from said printing station and said optical reading head moving means includes electromagnetic means operable to position the optical read head at the printing station during an optical reading operation.

12. In the passbook printer of claim 7 wherein the optical reading head moving means comprises a generally U-shaped member for supporting said optical reading head and means for driving the U-shaped member from said first position to said second position.

* * * * *